US006886614B2

(12) United States Patent
Ricono et al.

(10) Patent No.: US 6,886,614 B2
(45) Date of Patent: May 3, 2005

(54) PENCIL SHARPENER

(75) Inventors: Thomas R. Ricono, Clemmons, NC (US); Michael Lee Parrish, Huntersville, NC (US); Phillip Bruce Daley, Jr., deceased, late of Statesville, NC (US); by Sallie S. Daley, legal representative, Statesville, NC (US)

(73) Assignee: Hunt Holdings, Inc., Columbus, OH (US)

( * ) Notice: Subject to any disclaimer, the term of this patent is extended or adjusted under 35 U.S.C. 154(b) by 0 days.

(21) Appl. No.: 09/905,719

(22) Filed: May 16, 2002

(65) Prior Publication Data

US 2003/0213530 A1 Nov. 20, 2003

(51) Int. Cl.[7] ..... B43L 23/08

(52) U.S. Cl. ..... 144/28.11; 144/28.4; 144/28.7; 144/28.72; 30/453

(58) Field of Search ..... 144/28.1, 28.2, 144/28.3, 28.4, 28.5, 28.6, 28.7, 28.72, 28.8, 28.9; 30/451, 453, 454

(56) References Cited

U.S. PATENT DOCUMENTS

| | | | | |
|---|---|---|---|---|
| 2,335,148 A | | 11/1943 | Hoffman | |
| 2,545,779 A | | 3/1951 | Harrison | |
| 2,822,781 A | * | 2/1958 | Burton | 144/28.5 |
| 2,900,958 A | * | 8/1959 | Johnson | 144/28.71 |
| 3,134,365 A | * | 5/1964 | Hori | 144/28.5 |
| 3,650,308 A | * | 3/1972 | Hori | 144/28.5 |
| 3,678,975 A | * | 7/1972 | Imanishi et al. | 144/28.5 |
| 3,746,061 A | * | 7/1973 | Nakazaki | 144/28.5 |
| 4,054,164 A | * | 10/1977 | Kose et al. | 144/28.7 |
| 4,081,704 A | | 3/1978 | Vassos et al. | 310/50 |
| 4,406,315 A | | 9/1983 | Brickhouse | 145/3.31 |
| 4,485,862 A | | 12/1984 | Mattheis et al. | 145/3.1 |
| 4,506,716 A | | 3/1985 | Hayashi | 145/3.5 |
| 4,601,316 A | * | 7/1986 | Verdi | 144/28.72 |
| 4,625,462 A | | 12/1986 | Fushiya et al. | 51/170 MT |
| 4,730,134 A | | 3/1988 | Sistare | 310/50 |
| 4,755,074 A | | 7/1988 | Roberts | 401/52 |
| 4,759,129 A | | 7/1988 | Alpha | 30/452 |
| 5,052,453 A | | 10/1991 | Chen | 144/28.5 |
| 5,077,903 A | * | 1/1992 | Kreim | 30/451 |

(Continued)

FOREIGN PATENT DOCUMENTS

| | | | |
|---|---|---|---|
| DE | 39 01 728 A1 | 7/1990 | B25F/5/02 |
| DE | 198 05 577 A1 | 2/1998 | B25F/5/02 |
| FR | 2576232 | 1/1985 | B23B/45/02 |
| GB | 2323717 | 9/1998 | |
| WO | WO 96/07516 | 3/1996 | B26B/27/00 |
| WO | WO 97/22444 | 6/1997 | B25F/3/00 |
| WO | WO 99/15316 | 4/1999 | B25F/5/02 |
| WO | WO 99/32306 | 7/1999 | B43L/23/04 |

*Primary Examiner*—Allen Ostrager
*Assistant Examiner*—Shelley Self
(74) *Attorney, Agent, or Firm*—Kurt L. Ebresman; McNess Wallace & Nurick LLC

(57) ABSTRACT

A pencil sharpener having a sharpening sub-assembly for sharpening pencils, and first and second external shells having internal ribs defining surfaces for supporting the sharpening sub-assembly. Components of the sub-assembly are placed into corresponding portions defined by the internal ribs. The ribs ensure proper alignment of the components relative to the shell and each other, e.g. in the x- and y-directions. All components may be placed in the shell in a single direction, e.g. in a single axial direction (the z-direction). The components of the pencil sharpener are mounted in place upon fastening together of the first and second external shells. No internal or additional fasteners are required. The sharpening sub-assembly may include an electric motor, a gear assembly, and a cutter assembly including a cutter gear module having an annular ring gear, acting as a carrier support, and housing a pencil insertion switch and/or a receptacle presence switch.

18 Claims, 7 Drawing Sheets

U.S. PATENT DOCUMENTS 5,347,088 A 9/1994 Marsh et al. ..... 174/50
5,394,039 A 2/1995 Suchdev et al. ..... 310/51
5,642,008 A 6/1997 McCracken ..... 310/50
5,682,289 A 10/1997 Schwegler et al. ..... 361/679
5,714,815 A 2/1998 Fritzinger et al. ..... 310/89
5,718,014 A 2/1998 deBlois et al. ..... 15/22.1
5,828,544 A 10/1998 Matsuda ..... 361/641
5,875,555 A * 3/1999 Andrisin et al. ..... 30/452
5,944,494 A 8/1999 Soltani et al. ..... 417/312
5,987,759 A 11/1999 Nita ..... 30/454
6,427,343 B1 * 8/2002 Chang ..... 30/454

* cited by examiner

FIG.4A
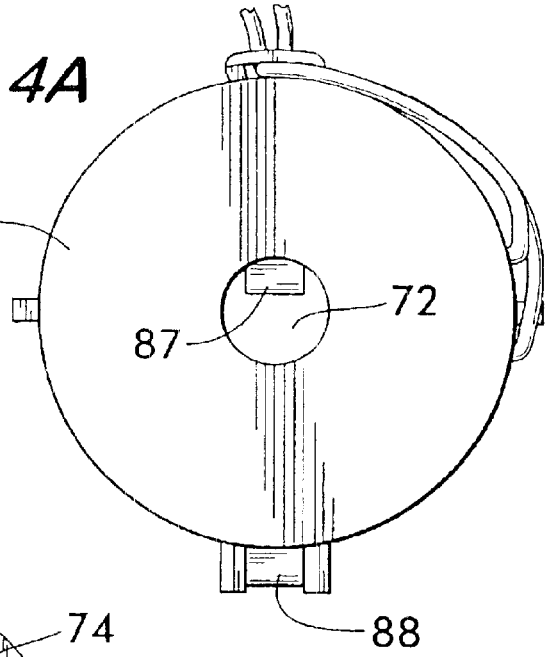
FIG.4B
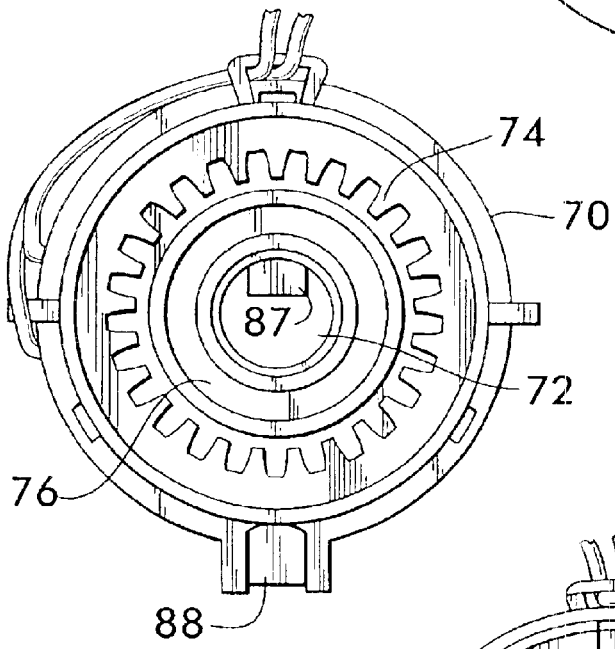
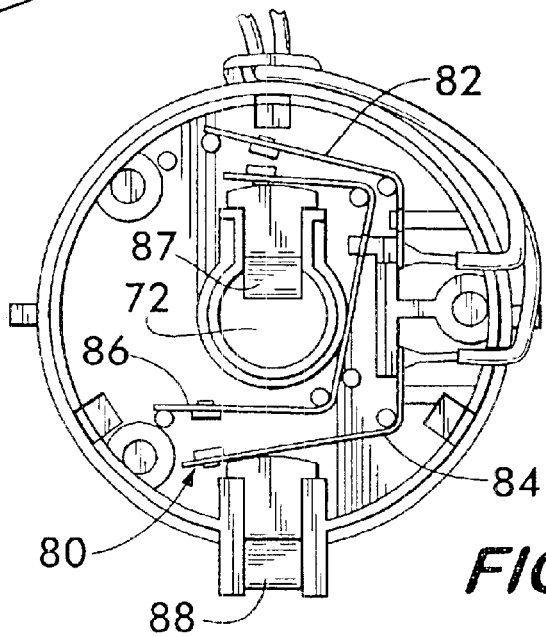
FIG.4C

PENCIL SHARPENER

FIELD OF THE INVENTION

The present invention relates generally to pencil sharpeners. More particularly, the present invention relates to an electric pencil sharpener having an internal structure which simplifies assembly and provides a corresponding reduction in production costs.

BACKGROUND OF THE INVENTION

Typical electric pencil sharpeners include an electric motor, a speed reducing gear train, a multi-piece cutter assembly, a pencil size selector guide and/or a pencil alignment device, and a switch for activating the motor, e.g. upon insertion of a pencil. A removable receptacle may also be provided for collecting shavings with some pencil sharpeners. These sharpeners may include a receptacle presence switch for preventing operation of the motor unless the removable receptacle is fitted to the housing.

Many of the above components e.g, the motor, gear train and cutter assembly are mounted on various internal support structures within the housing to permit precise alignment thereof for proper operation and sharpening. The internal support structures are typically supported by a base structure. An external housing or cover is then mounted to the base structure to enclose the internal support structures and operative components. Pencil sharpeners exemplifying one or more of these characteristics are shown in U.S. Pat. No. 2,335,148 to Hoffman, U.S. Pat. No. 2,545,779 to Harrison, U.S. Pat. No. 2,822,781 to Burton, U.S. Pat. No. 2,900,958 to Johnson, U.S. Pat. No. 3,134,365 to Hori, and U.S. Pat. No. 4,601,316 to Verdi.

These and other known pencil sharpeners are composed of numerous parts, resulting in increased costs of manufacturing the various parts and in increased costs of assembling those parts into subassemblies and to complete the pencil sharpener. Additionally, such parts and/or subassemblies are typically oddly shaped, and must be positioned and/or fastened in multiple planes or along multiple axes, further complicating the assembly process. Such assembly requires either manual assembly or complex automated machinery, both of which are expensive.

What is needed is a pencil sharpener that requires fewer, simpler parts, allowing for positioning and/or fastening of parts and/or subassemblies in fewer planes, and/or that may be quickly and easily assembled, e.g., by automated pick-and-place assembly equipment.

SUMMARY OF THE INVENTION

The present invention provides a pencil sharpener including external shells having integral internal ribs for receiving and retaining internal components of the pencil sharpener, such as an electric motor, a gear assembly, and a cutter assembly. In this manner, all internal components may be placed into corresponding portions defined by the internal ribs of an external shell. The ribs ensure proper alignment of the components relative to one another and to the shell in the x- and y-directions and temporarily, for assembly purposes, in the z-direction. All components may be placed in the shell in a single direction, e.g. in a single axial direction (e.g., the z-direction).

A second external shell is matable with the first shell. The second external shell includes complementary internal ribs for securing the components in place, e.g. in the x- and y-directions, and in cooperation with the first external shell, fixedly in the z-direction. Preferably, the first and second external shells are configured to allow mating of the second external shell with the first external shell in a single axial direction, e.g. the z-direction. Additionally, it is preferable that fasteners for securing the second external shell to the first external shell are applied in a single axial direction, e.g. the same axial direction, e.g. the z-direction. Accordingly, the components of the pencil sharpener are mounted in place upon fastening together of the first and second external shells. No internal or additional fasteners are required.

In a highly preferred embodiment, the cutter assembly includes a cutter gear module having a toothed ring gear which acts as a carrier support. In a very highly preferred embodiment, the cutter gear module houses a pencil insertion switch and a receptacle presence switch. In one such embodiment, a dual switch mechanism incorporated into the cutter gear module prevents operation of the electric motor unless the pencil is inserted and the receptacle is mated with the first and second external shells.

DESCRIPTION OF THE DRAWINGS

FIG. 4A is a front view of the cutter gear module shown in FIG. 2A;

FIG. 4B is a rear view of the cutter gear module shown in FIG. 2A, showing a ring gear component;

FIG. 4C is rear view of the cutter gear module of FIG. 4, showing the ring gear component removed;

DETAILED DESCRIPTION

Figure 1:
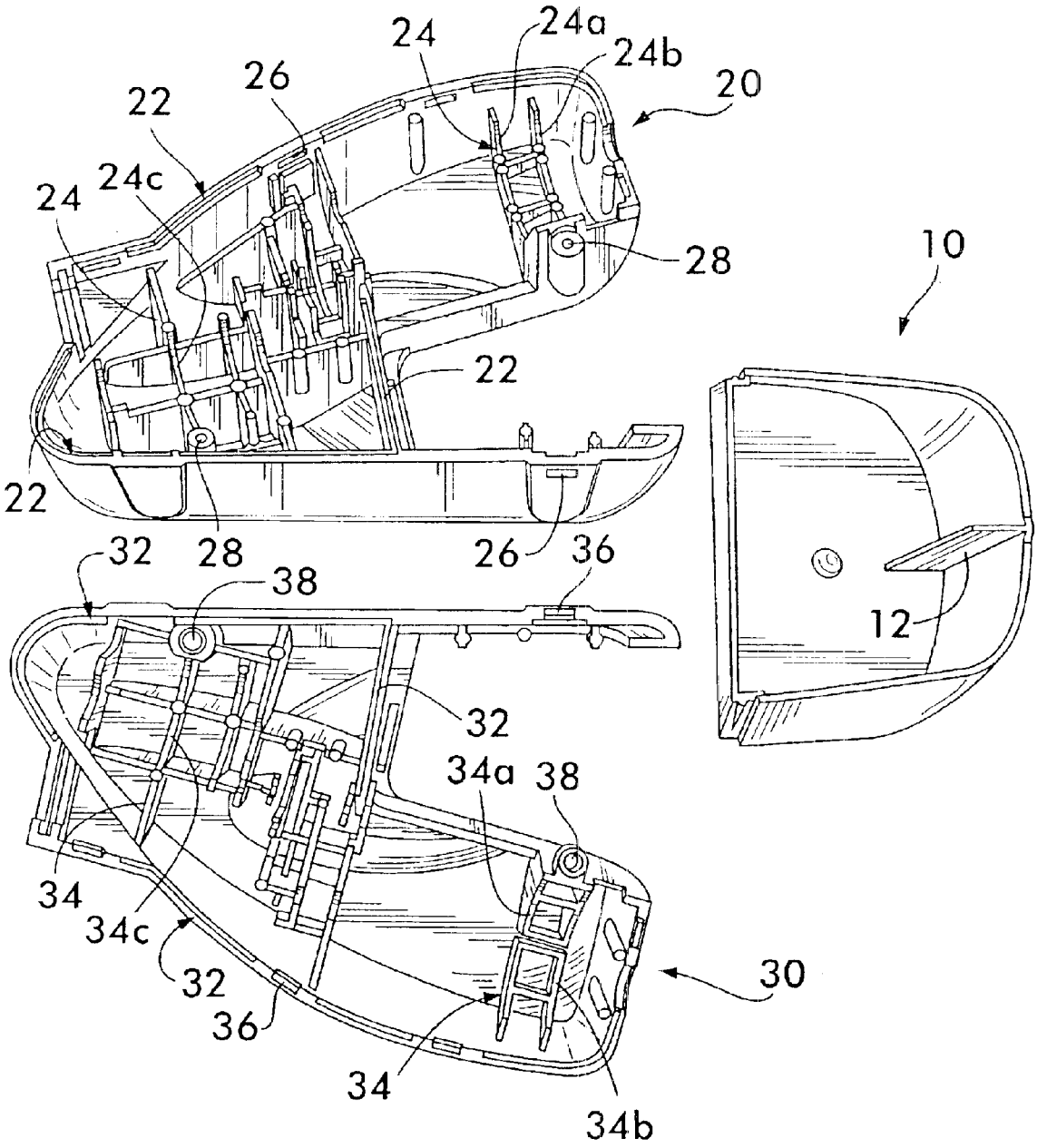
FIG. 1 is a perspective view of an exemplary receptacle and exemplary first and second external shells in accordance with one embodiment of the present invention, showing internal ribs.
Figure 6:
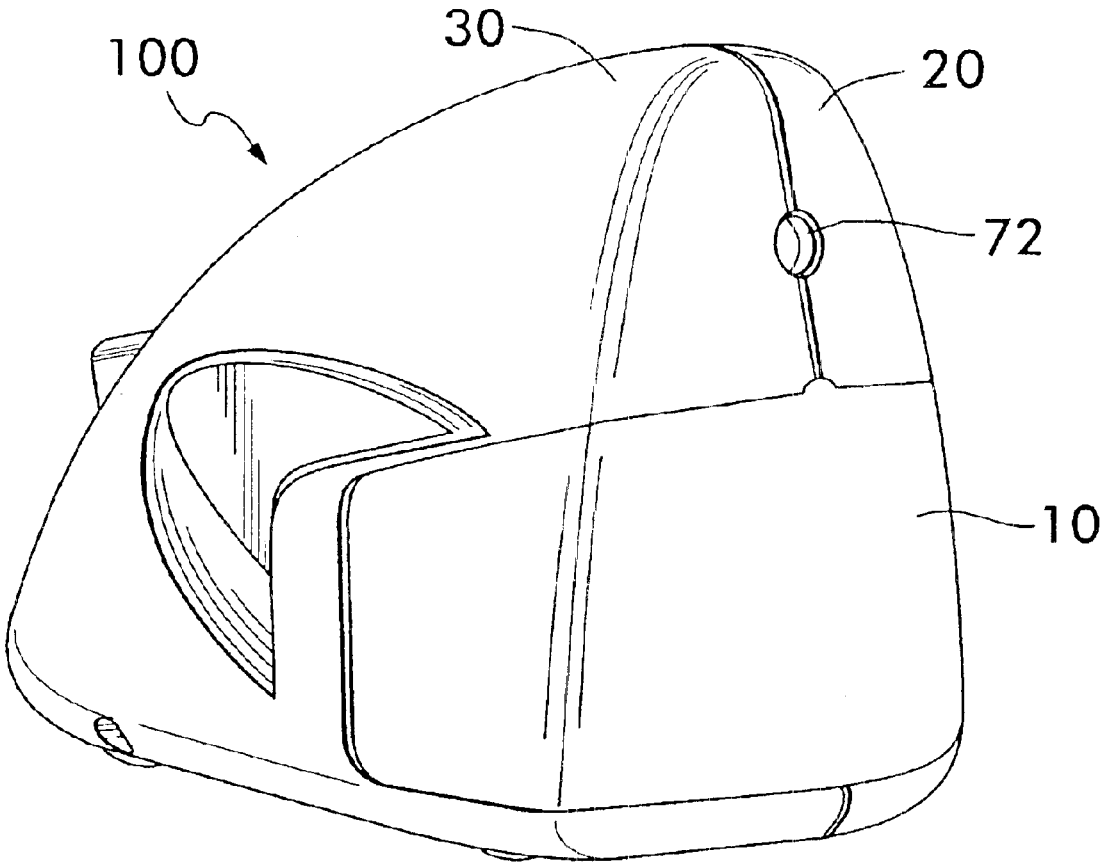
FIG. 6 is a front perspective view of a pencil sharpener showing mating of the shells, receptacle and components of FIG. 2B.

FIG. 1 is a perspective view of first and second external shells 20, 30 which can be mated to form the housing 21 of the pencil sharpener 100 shown in FIG. 6. A receptacle 10 is configured to be removably matable with the first and second external shells 20, 30 for receiving pencil shavings discharged from a sharpening sub-assembly of the pencil sharpener. As shown in FIG. 1, first external shell 20 has internal ribs 24 defining a first plurality of support surfaces, e.g. 24*a*, 24*b*, 24*c*. The support surfaces can be a semi-circle, a semi-square, a semi-rectangle, or other open shape, as discussed below. Similarly, the second external shell 30 has internal ribs 34 defining a second plurality of support surfaces, e.g. 34*a*, 34*b*, 34*c*. The first and second pluralities of support surfaces are complementary in that they cooperate to fixedly retain the internal components in a predefined x, y, z spatial relationship when the external shells 20, 30 are mated.

The second external shell 30 is matable with first external shell 20 to define a substantially closed compartment. For this purpose, first and second external shells 20, 30 have interengageable mating surfaces 22, 32, interlockable tab means 26, 36, and complementary fastener bosses 28, 38. In a preferred embodiment, the receptacle 10 and first and second external shells 20, 30 are formed of a suitable plastic by injection molding to integrally form the internal ribs. In this manner, the base structure, multiple internal support structures, and external cover of the pencil sharpener, traditionally separate parts as known in the prior art, are all integrated into two external shells 20, 30. This reduces manufacturing and assembly costs.

Figure 2A:
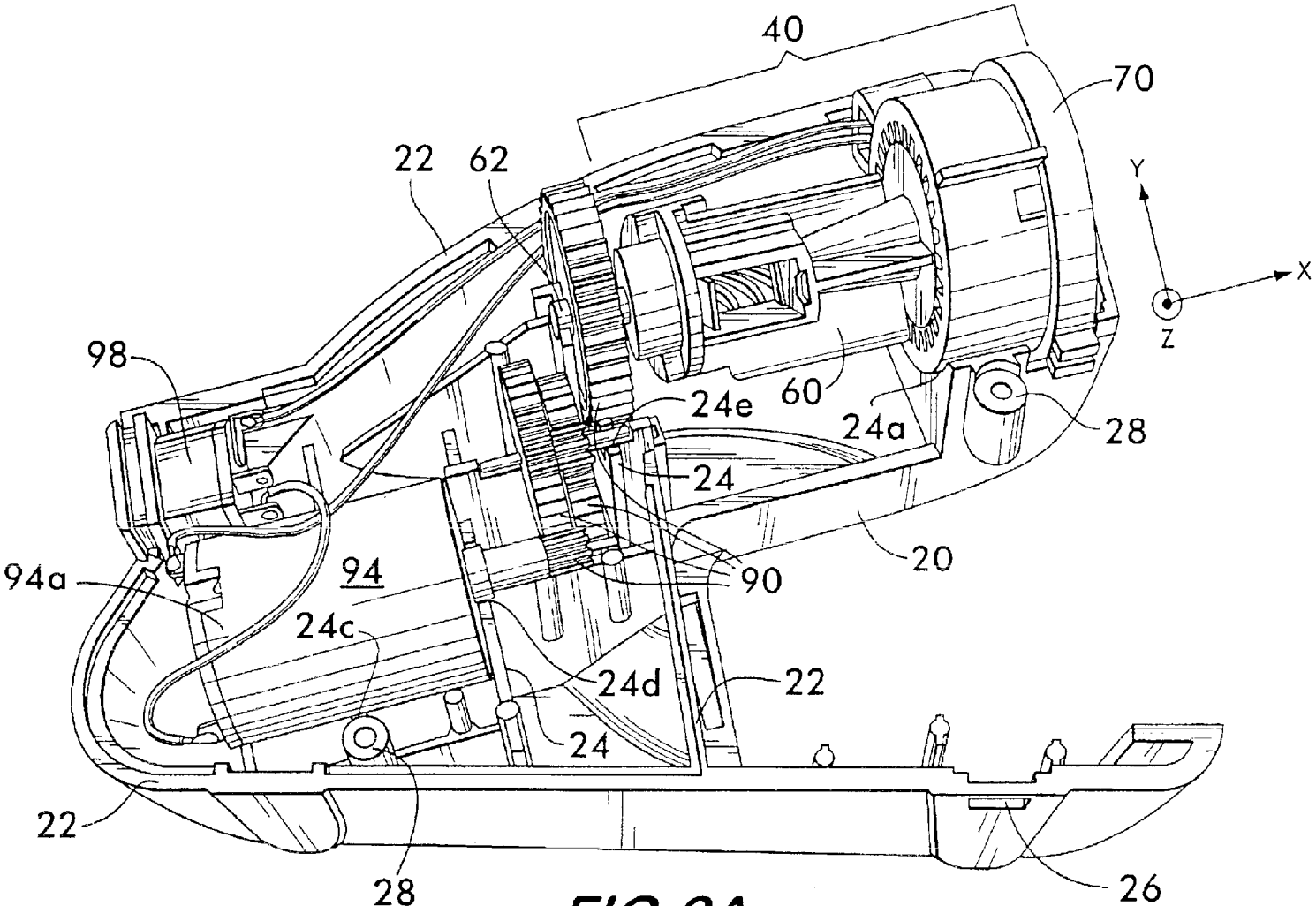
FIG. 2A is a perspective view of the first external shell shown in FIG. 1, showing pencil sharpener components, including a cutter gear module in accordance with one embodiment of the present invention, positioned within the shell.

Advantageously, the support surfaces of one of the shells 20, 30, e.g. first external shell 20, act as a template for assembling components of the pencil sharpener, and the support surfaces act as cradles to position and temporarily retain the components during assembly. For example, support surface 24*c* is substantially semi-circular for cradling the cylindrically-shaped housing 94*a* of the motor 94 as shown in FIG. 2A. When the support surfaces are open surfaces, all components of the pencil sharpener may be quickly and easily inserted into the shell in a single direction, e.g. the z-direction, e.g. by automated pick-and-place assembly robots. The support surfaces are formed relative to the shells and to one another to ensure proper positioning and alignment of the various components, in the x-, y- and z-directions. Because the external shells have complementary support surfaces, the first and second pluralities of support surfaces can serve as the sole means of mounting the components in place in the compartment formed by the shells. This simplifies the assembly process by eliminating assembly steps, e.g. the fastening of individual parts or sub-assemblies to the shell. This reduces manufacturing and assembly costs and simplifies assembly.

Figure 2B:
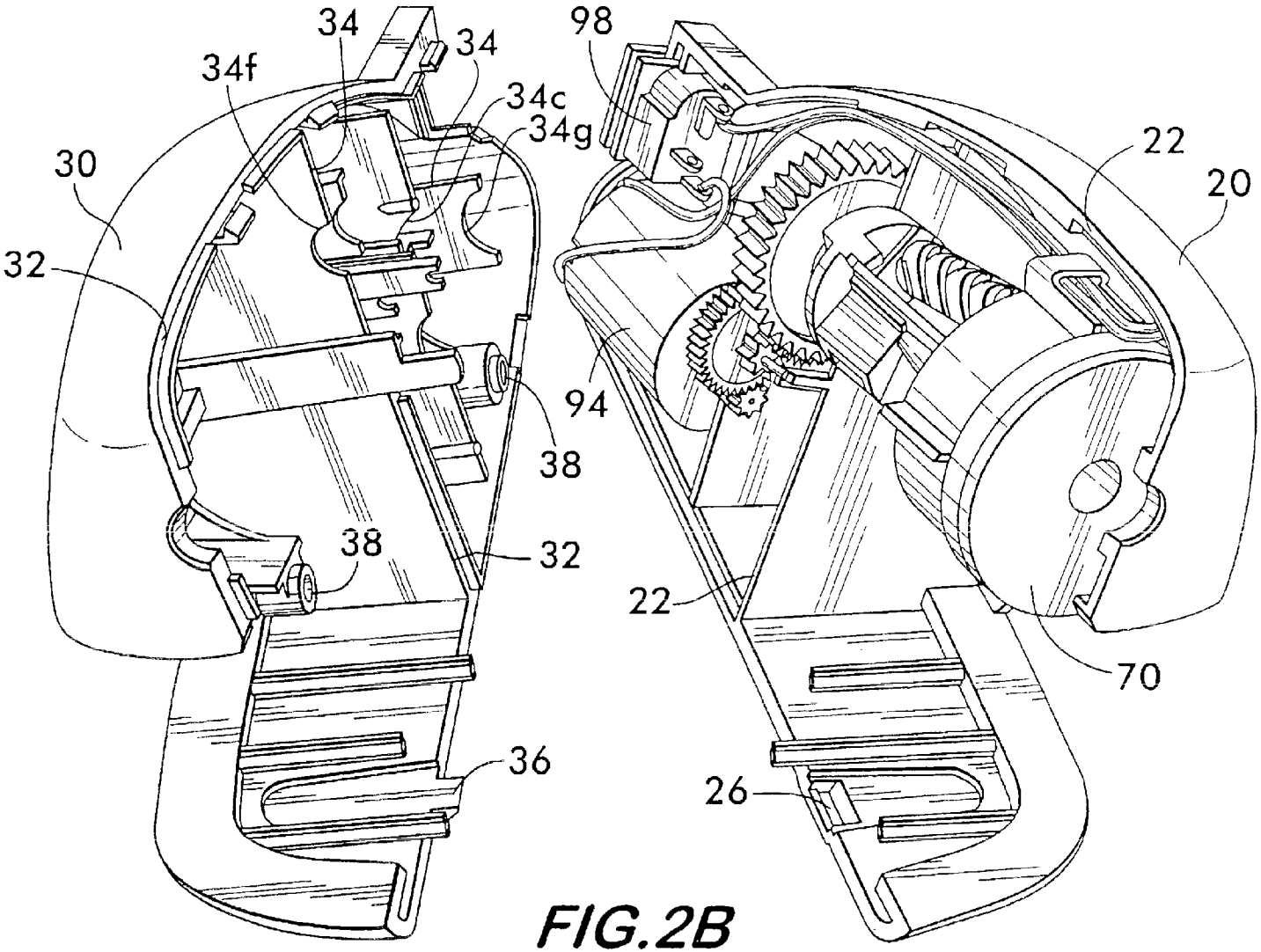
FIG. 2B is a perspective view of the shells, receptacle and components of FIG. 2A.

FIG. 2A is a perspective view of the first external shell 20 of FIG. 1, showing pencil sharpener components placed within first external shell 20 and supported by support surfaces, e.g. 24*a*, 24*d*, 24*e* of the internal ribs 24. As shown in FIG. 2A, exemplary pencil sharpener components include a sharpening sub-assembly 40, a speed-reducing gear train 90, a self-contained electric motor 94 for driving the sharpening sub-assembly 40, and a power cord connector 98. Complementary internal ribs 34 and support surfaces, e.g. 34*f*, 34*g*, of the second external shell 30 are shown in FIG. 2B.

With reference to FIG. 2A, the sharpening sub-assembly 40 includes a cutter assembly 50 and a cutter gear module 70, as discussed in detail below with reference to FIGS. 3–5B. However, the sharpening sub-assembly 40 may include comparable components with various different structures.

Figure 3:
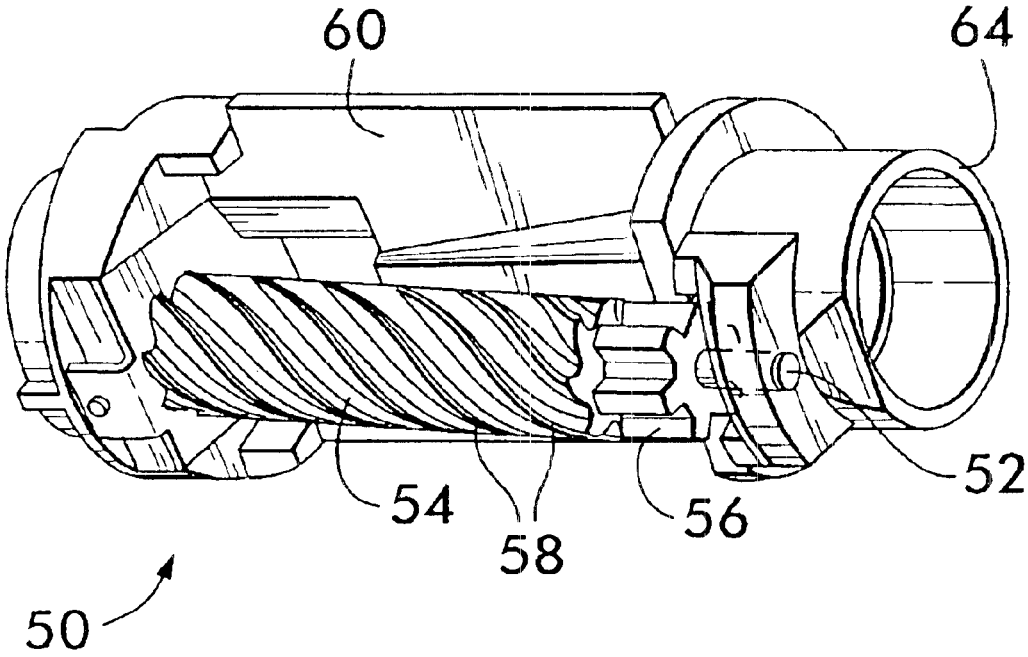
FIG. 3 is a perspective view of the cutter assembly shown in FIG. 2A.

As shown in FIG. 3, cutter assembly 50 includes a blade-supporting shaft 52, and a rotary blade 54 and pinion 56 carried co-axially on the shaft 52. In one embodiment, the blade and pinion are fixedly mounted on a rotatable shaft (not shown). In an alternate embodiment, the blade is fixedly mounted to the pinion and both are rotatably mounted on a fixed shaft (not shown). The rotary blade 54 has spiral cutting edges 58. The cutter assembly 50 also includes a blade holder 60 defining a cavity, e.g., a conical cavity (not shown), for receiving an end of a pencil (not shown) therein and supporting the shaft 52. The blade holder 60 defines a ring flange 64. A drive shaft 62 engages the blade holder 60 for driving the blade holder 60 of the cutter assembly 50, as best shown in FIG. 2A.

Figure 5A:
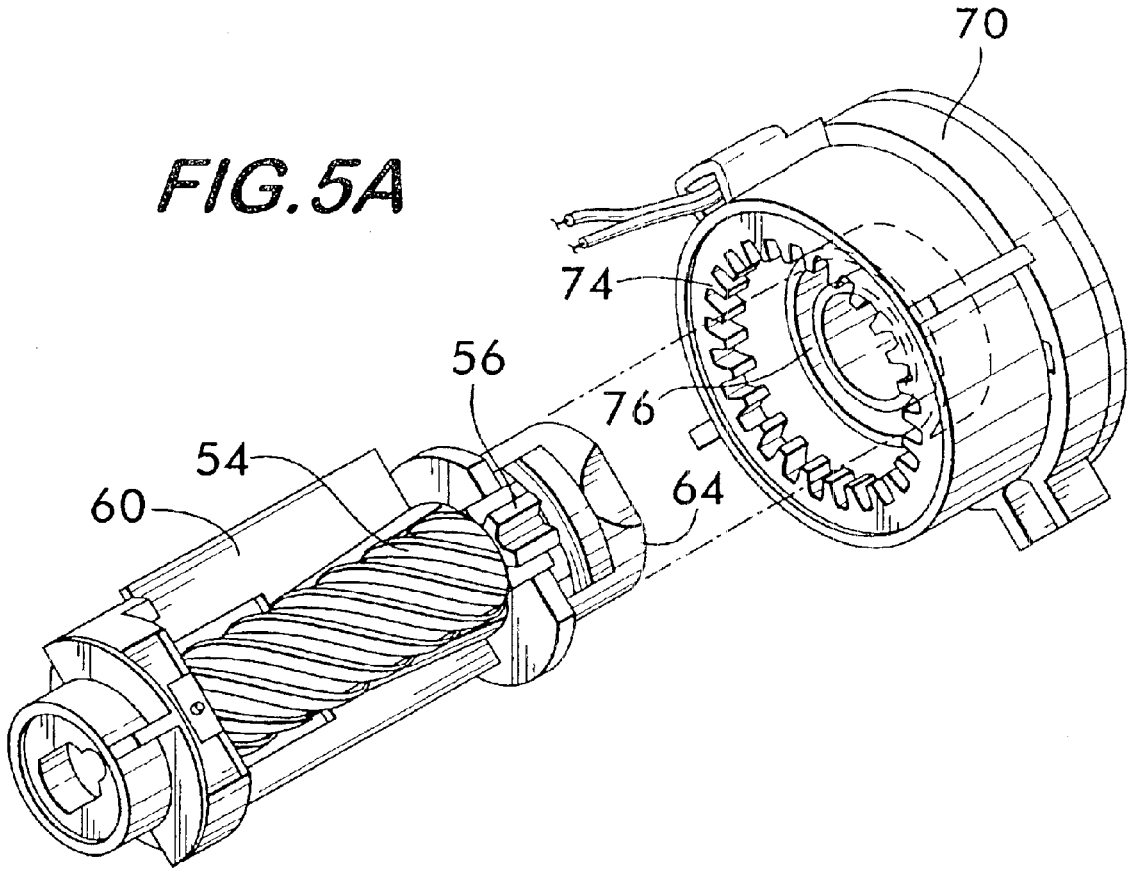
FIG. 5A is an exploded view of the mating of the cutter assembly of FIG. 2A and the cutter gear module of FIG. 4B.
Figure 5B:
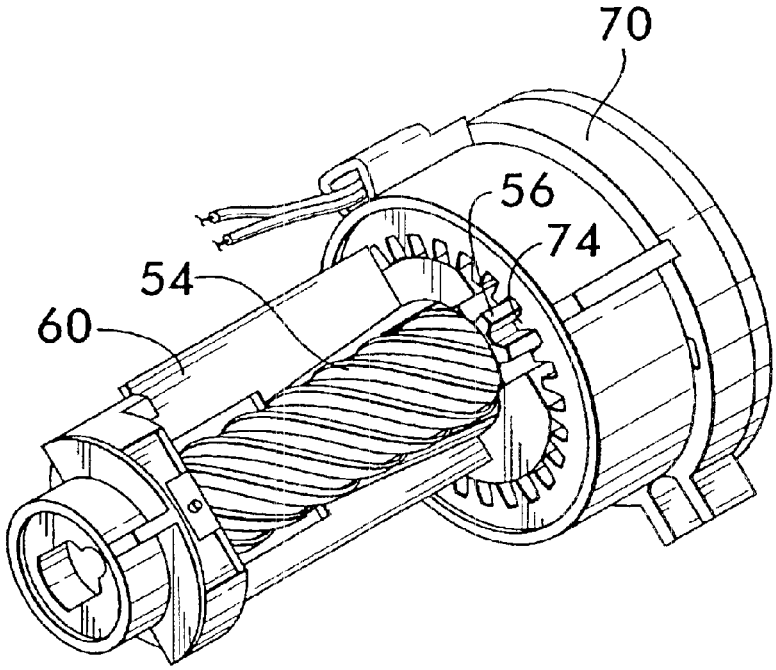
FIG. 5B is a perspective view of the cutter assembly of FIG. 2A mated with the cutter gear module of FIG. 4B.

Efficient assembly of a pencil sharpener having external shells with complementary internal ribs is greatly enhanced by the use of a cutter gear module 70 in accordance with the present invention. FIGS. 4A and 4B are front and rear views of the cutter gear module 70 of FIG. 2A. As shown in FIGS. 4A and 4B, the cutter gear module 70 defines a pencil-receiving opening 72 and includes an annular ring gear 74 for meshing with the pinion 56 of the cutter assembly 50. The cutter gear module 70 defines a ring groove 76 for registering with the ring flange 64 of the cutter assembly 50. In this manner, the blade holder 50 is rotatably supported by the gear module 70 when the ring flange 64 is positioned within the ring groove 76 when the cutter assembly 50 and cutter gear module 70 are mated, as shown in FIGS. 5A and 5B. The integration of several components of the prior art into the inventive cutter gear module simplifies assembly, reduces manufacturing and assembly costs, and permits assembly by axial placement in an external shell.

The cutter assembly 50 and cutter gear module 70 are properly mated by placing the cutter assembly 50 and cutter gear module 70 in contact with corresponding support surfaces of at least one of the external shells 20, 30. Accordingly, for example, the support surfaces are configured to position and support the cutter assembly 50 and cutter gear module 70 in mechanically interengaging positions that provide for operability of the sharpening sub-assembly. After the external shells are mated, the blade holder 60 is supported by the first and second external shells 20, 30 to be rotatable around an axis of the cavity, as shown in FIG. 2A. The blade holder 60 and cutter assembly 50 are operatively coupled to electric motor 94 by the speed-reducing gear train 90, as shown in FIG. 2A. Accordingly, when the electric motor 94 is powered, the electric motor 94 causes the drive shaft 62 to rotate and thereby drives the blade holder 60 around the cavity, causing the pinion 56 to travel along the annular ring gear 74 and the rotary blade 54 to rotate and sharpen a pencil in the cavity, as discussed further below.

FIG. 4C is a rear view of the cutter gear module of FIG. 4, showing the annular ring gear 74 removed. The cutter gear module 70 is a self-contained unit incorporating the annular ring gear and one or more switches, and is capable of being mounted in a shell by placement in a single direction, e.g., in the z-direction. The exemplary cutter gear module 70 shown in FIG. 4C houses a pencil insertion switch and a receptacle presence switch in the form of a dual switch.

As shown in FIG. 4C, the dual switch 80 includes a first electrically conductive contact 82 connected electrically to a first side of a circuit powering the electric motor 94 and a second electrically conductive contact 84 connected electrically to a second side of a circuit powering the electric motor 94. The first and second contacts 82, 84 are mounted to the cutter gear module 70. A third contact 86 is mounted to the cutter gear module 70 in spaced relationship to the first and second contacts 82, 84 (as shown in FIG. 4A, a first pawl 87 is mounted on the cutter gear module 70 in position to cause the third contact 86 (FIG. 4C) to connect electrically with the first contact 82 responsive to insertion of a pencil into the pencil-receiving opening 72). A second pawl 88 (FIG. 4C) is mounted on the cutter gear module 70 in position to cause the third contact 86 to electrically connect with the second contact 84 responsive to mating of a receptacle 10 with the first and second external shells 20, 30.

Accordingly, the dual switch 80 is operatively connected to the electric motor 94 for driving the sharpening subassembly 40 only when the dual switch 80 is activated by inserting a pencil into the pencil-receiving opening 72 and mating a receptacle 10 with the first and second external shells 20, 30. In other words, the dual switch 80 will cause the electric motor 94 to drive the sharpening sub-assembly 40 only when the first pawl 87 is engaged by a pencil to cause the first and third contacts 82, 86 to electronically connect, and the second pawl 88 is engaged by the receptacle to cause the second and third contacts 84, 86 to contact, thereby closing the circuit. The receptacle 10 is provided with an internal fin 12 for contacting the second pawl 88 of the dual switch 80, as shown in FIG. 1 and FIGS. 4A–4C.

After all the components are placed in the first shell 20, as shown in FIG. 2A, the second external shell 30 is placed over the first external shell 20, causing interengagement of mating surfaces 22, 32 and interlocking of tab means 26, 36. Due to the design of the support surfaces this may be performed by advancing the second shell in the same direction (z-direction) used for placement of the components, which is particularly suitable for automated pick-and-place robotic assembly, resulting in lower assembly costs. Finally, screws or other fasteners are driven through the complementary fastener bosses 28, 38 to lock the external shells together. Here, the external shells 20, 30 are locked together, thereby fixedly retaining the internal components within the compartment formed by the shells. Advantageously, the fasteners may be advanced in the same z-direction, and therefore may be completed by an automated assembly process.

Thus, the pencil sharpener may be quickly and easily assembled e.g., in an automated fashion, from relatively few, simple components, resulting in significant savings of manufacturing and assembly costs.

FIG. 6 shows the pencil sharpener 100 after mating of components shown in FIG. 2B.

The exemplary pencil sharpener 100 of FIG. 6 can be readied for use by connecting the pencil sharpener to a suitable power supply and mating the receptacle 10 with the combined first and second external shells 20, 30. The internal fin 12 of the receptacle 10 (FIG. 1) causes the second pawl 88 (FIG. 4A) to pivot and close the second and third contacts 84, 86. However, the circuit powering the motor 94 is not yet closed and so the pencil sharpener is still inoperable, which is advantageous for safety purposes to prevent injury by accidental contact with an operating rotary blade. The pencil sharpener 100 may then be operated by inserting a pencil through the pencil receiving opening 72 of the cutter gear module 70. This causes the first pawl 87 to pivot and close the first and third contacts 82, 86. This closes the circuit powering the motor 94 and causes the motor to operate, thereby driving the gear train 90, and causing the cutter assembly 50 to rotate on the drive shaft 62. This rotation causes pinion 56 to travel around the annular ring gear 74, thereby causing the rotary blade 54 to rotate and sharpen the pencil. Sharpening continues until the pencil is removed from the pencil receiving opening 72, at which time the pawl 87 pivots to open the power circuit, and the motor 94 stops running. Similarly, the circuit is opened when receptacle 10 is removed from the external shells 20, 30.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A pencil sharpener comprising:

a first longitudinally elongated external shell having internal ribs defining a first plurality of support surfaces;

a sharpening sub-assembly for sharpening a pencil, said sharpening sub-assembly comprising:

a blade-supporting shaft;

a rotary blade and a pinion supported co-axially on said blade-supporting shaft, said rotary blade having spiral cutting edges;

a blade holder defining a cavity for receiving an end of the said pencil therein and supporting said blade-supporting shaft, said blade holder being supported by said first and second external shells to be rotatable around an axis of said cavity;

a cutter gear module defining a pencil-receiving opening and including an annular ring gear meshing with said pinion; and a drive shaft which drives said blade holder around said axis; and a second longitudinally elongated external shell mated with said first external shell to define a substantially closed compartment, said second external shell having internal ribs defining a second plurality of support surfaces;

wherein each support surface extends along an edge of a respective internal rib, and wherein said first and second pluralities of support surfaces cooperate with each other to laterally position and fixedly retain said sharpening sub-assembly within said shells; and wherein said drive shaft is capable of driving said blade holder around said cavity, causing said pinion to travel along said annular ring gear and said rotary blade to rotate and sharpen the pencil advanced into said cavity.

2. The pencil sharpener of claim 1, wherein said blade holder defines a ring flange and said cutter gear module defines a ring groove for registering with said ring flange; and wherein said blade holder is rotatably supported at one end by said cutter gear module when said ring flange is positioned within said ring groove, said cutter gear module being supported by said first and second external shells.

3. The pencil sharpener of claim 1, further comprising:

an electric motor operatively connected to said sharpening sub-assembly for driving said sharpening subassembly, said first and second pluralities of support surfaces cooperating with each other to engage and retain said electric motor in response to mating of said first and second external shells, said first and second pluralities of support surfaces serving as the sole means of mounting said electric motor in said compartment;

wherein said motor gear module comprises a switch operatively connected to said electric motor for driving said sharpening sub-assembly when said switch is activated upon insertion of the pencil into said pencil-receiving opening.

4. The pencil sharpener of claim 3, wherein said switch comprises a pawl and a pair of contacts mounted on said cutter gear module, said pawl being positioned to cause said pair of contacts to electronically connect for closing a circuit.

5. The pencil sharpener of claim 1, wherein said cutter gear module comprises: a switch operatively connected to said electric motor for preventing operation of said motor unless said switch is activated by mating of a receptacle with said first and second external shells.

6. The pencil sharpener of claim 5, wherein said switch comprises a pawl and a pair of contacts mounted on said cutter gear module, said pawl being positioned to cause said pair of contacts to electronically connect for closing a circuit.

7. The pencil sharpener of claim 1, further comprising:

a dual switch operatively connected to said electric motor for driving said sharpening sub-assembly only when said dual switch is activated by a pencil inserted into said pencil-receiving opening and by a receptacle mated with said first and second external shells.

8. The pencil sharpener of claim 7, wherein said dual switch comprises:

a first contact electrically connected to a first side of a circuit powering said electric motor;

a second contact electrically connected to a second side of said circuit;

a third contact mounted in spaced relationship to said first and second contacts;

a first pawl mounted on said cutter gear module in position to cause said third contact to electrically connect with said first contact responsive to insertion of a pencil into said pencil-receiving opening; and a second pawl mounted on said cutter gear module in position to cause said third contact to electrically connect with said second contact responsive to mating of a receptacle with said first and second external shells.

9. The pencil sharpener of claim 8, further comprising a receptacle removably matable with said first and second external shells for receiving pencil shavings discharged from said sharpening sub-assembly.

10. The pencil sharpener of claim 9, wherein said receptacle comprises an internal fin positioned to contact said second pawl of said dual switch.

11. A pencil sharpener comprising:

a first external shell having internal ribs defining a first plurality of support surfaces;

a cutter assembly defining a ring flange and having a rotatable pinion;

a gear module defining a pencil-receiving opening and including an annular ring gear meshing with said pinion, said gear module defining a ring groove for registering with said ring flange;

a second external shell mated with said first external shell to define a substantially closed compartment, said second external shell having internal ribs defining a second plurality of support surfaces;

whereby said cutter assembly is rotatably supported at one end by said gear module when said ring flange is positioned within said ring groove;

wherein each internal rib comprises a first side and a second side opposite said first side, each of said first and second sides adjoining one of said first and second external shells, each of said first and second pluralities of support surfaces extending between a respective first and second side of a respective rib; and wherein said first and second pluralities of support surfaces cooperate with each other to engage and retain said cutter assembly and said gear module in said compartment, at least one of said support surfaces positioning and supporting said cutter assembly in a predetermined operative spatial relationship relative to said gear module, said gear module being separately positioned and supported by another of said support surfaces.

12. The pencil sharpener of claim 11, wherein said first and second pluralities of support surfaces serve as the sole means of mounting said cutter assembly and said gear module in said compartment.

13. The pencil sharpener of claim 11, wherein said cutter assembly comprises:

a blade-supporting shaft;

a rotary blade carried coaxially on said blade-supporting shaft said rotary blade having spiral cutting edges;

a blade holder defining a cavity for receiving an end of a pencil therein and supporting said blade-supporting shaft, said blade holder being supported by said first and second external shells to be rotatable around an axis of said cavity; and a drive shaft which drives said blade holder around said axis;

wherein said pinion is carried co-axially on said shaft;

whereby said blade holder is rotatably supported at one end by said gear module when said ring flange is positioned within said ring groove, said gear module being supported by said first and second external shells; and whereby said drive shaft is capable of driving said blade holder around said cavity, causing said pinion to travel along said annular ring gear and said rotary blade to rotate and sharpen any pencil advanced into said cavity.

14. The pencil sharpener of claim 13, further comprising:

a dual switch operatively connected to said electric motor for driving said sharpening sub-assembly only when said switch is activated by a pencil inserted into said pencil-receiving opening and by a receptacle mated with said first and second external shells.

15. The pencil sharpener of claim 14, wherein said dual switch comprises:

a first contact electrically connected to a first side of said circuit powering said electric motor;

a second contact electrically connected to a second side of a said circuit;

a third contact mounted in spaced relationship to said first and second contacts;

a first pawl mounted on said cutter gear module in position to cause said third contact to electrically connect with said first contact responsive to insertion of a pencil into said pencil-receiving opening; and a second pawl mounted on said cutter gear module in position to cause said third contact to electrically connect with said second contact responsive to mating of a receptacle with said first and second external shells.

16. The pencil sharpener of claim 15, further comprising:

an electric motor operatively connected to said cutter assembly for driving said cutter assembly, said first and second pluralities of support surfaces cooperating with each other to engage and retain said electric motor in said compartment when first and second external shells are mated, said first and second pluralities of support surfaces serving as the sole means of mounting said electric motor in place in said compartment; and a receptacle removably matable with said first and second external shells for receiving pencil shavings discharged from said sharpening sub-assembly.

17. The pencil sharpener of claim 16, wherein said receptacle comprises an internal fin positioned to contact said second pawl of said dual switch.

18. The pencil sharpener of claim 11, wherein each of said first and second external shells is elongated in a longitudinal direction, and wherein said first and second pluralities of support surfaces cooperate with each other to laterally position said cutter assembly and said gear nodule in said compartment.

* * * * *

UNITED STATES PATENT AND TRADEMARK OFFICE

CERTIFICATE OF CORRECTION

PATENT NO. : 6,886,614 B2
DATED : May 3, 2005
INVENTOR(S) : Ricono et al.

It is certified that error appears in the above-identified patent and that said Letters Patent is hereby corrected as shown below:

Title page,
Item [74], *Attorney, Agent, or Firm*, "Kurt L. Ebresman" should be
-- Kurt L. Ehresman --.

Column 10,
Line 2, "nodule" should be -- module --.

Signed and Sealed this

Fourteenth Day of March, 2006

JON W. DUDAS
*Director of the United States Patent and Trademark Office*